US006119286A

United States Patent [19]

Briscoe

[11] Patent Number: 6,119,286

[45] Date of Patent: Sep. 19, 2000

[54] DEVICE FOR MAKING BUBBLES IN BATH WATER

[76] Inventor: James P. Briscoe, Rte. 1, Box 430, Big Cabin, Okla. 74332

[21] Appl. No.: 09/332,493

[22] Filed: Jun. 14, 1999

[51] Int. Cl.[7] ..... A47K 3/02

[52] U.S. Cl. ..... 4/675; 4/559; 239/211; 239/229

[58] Field of Search ..... 4/675, 678, 559, 4/490; 239/211, 229; 472/128

[56] References Cited

U.S. PATENT DOCUMENTS

| | | | |
|---|---|---|---|
| 1,918,874 | 7/1933 | Shannahan | 239/211 |
| 2,968,120 | 1/1961 | Reed | 239/211 |
| 3,074,078 | 1/1963 | Varian | 4/490 |
| 3,315,692 | 4/1967 | Arenson | 4/490 |
| 5,125,577 | 6/1992 | Frankel | 4/678 |
| 5,217,161 | 6/1993 | Souza | 239/211 |

*Primary Examiner*—Charles R. Eloshway
*Attorney, Agent, or Firm*—Molly D. McKay

[57] ABSTRACT

A device for causing bubble bath to form bubbles in bath water. The body of the device floats on the surface of bath water as the bathtub fills with water and sprays water downward onto the surface of the water as the body moves from side to side. A float mechanism that is provided in a lower portion of the body allows the body to float. The device is preferably formed into the shape of an animal or other friendly form. A flexible housing on one end of the device removably secures to a water faucet or tub spout. A flexible hose that attaches to the housing is coextensive with a conduit that runs through the floating body and attaches to a spray head provided on the body so that water from the faucet or spout is sprayed out the spray head. One or more rudders may optionally be rotatably provided on a lower portion of the body to assist the body in moving from side to side in the water.

6 Claims, 2 Drawing Sheets

DEVICE FOR MAKING BUBBLES IN BATH WATER

BACKGROUND OF THE INVENTION

1. Field of the Invention

The present invention relates to a device for attachment to a water faucet or tub spout for spraying water onto the water surface in a bathtub for the purpose of agitating bubble bath product that is added to the water in the bathtub to produce bubbles. Also, the side to side movement of the device as it floats on the water surface is entertaining to the occupant of the bathtub.

2. Description of the Related Art

Currently there are devices that attach to the side of the bathtub and direct a stream of water into the bathtub. One disadvantage of these types of devices is that they are secured to the side of the bathtub and to not automatically adjust their vertical position relative to the rising level of water in the bathtub as the tub fills with water. The primary purpose of these types of devices is to produce agitation of the water, similar to a whirlpool action. These types of devices are not designed to agitate the water to produce an abundance of bubbles in the bath water by creating a side to side movement in the water.

The present invention addresses this problem by providing a device that floats on the surface of the water in a bathtub as the tub is filling with water. The present invention receives water from a water faucet or tub spout via a flexible hose that allows the device to move from side to side on the surface of the water as the water is directed downward in a spray onto the surface of the water. This combination of a downward directed spray of water and the side to side movement produced by the present invention is similar to the action of a hand moving rapidly back and forth in the bath water. This action causes bubble bath that is separately added to the bath water to foam and form a profusion of bubbles. The device is preferable formed into the shape of an animal or other friendly form that would be a pleasant bath companion to a child and that could entertain the child with its side to side movements on the surface of the water.

SUMMARY OF THE INVENTION

The present invention is a device for floating on the water surface of water in a bathtub as the bathtub fills with water. The device is preferably formed into the shape of an animal or other friendly form. One end of the device is provided with a flexible housing that is designed to encase a water faucet or tub spout. Water from the water faucet or tub spout is forced to flow through the housing into a flexible hose that runs through a body of the device. The hose connects to a spray head provided on an opposite end of the device so that the water sprays downward forcefully onto the surface of the water in the bathtub.

The body of the device is provided with a float mechanism in the lower portion of the body. The float mechanism may be either Styrofoam or an enclosed air pocket or other suitable buoyant mechanism. The float mechanism causes the body of the device to float on the surface of the water as the water from the faucet or spout flows through the device. The flexible hose that connects the body to the housing allows the body of the device to move from side to side in the bathtub.

Optionally, one or more rudders that rotate freely relative to the body of the device may be provided extending downward from the lower portion of the body. The purpose of the rudder or rudders is to extend downward into the bath water and to facilitate in the side to side movement of the body on the surface of the water.

DETAILED DESCRIPTION OF THE PREFERRED EMBODIMENT

Device For Making Bubbles in Bath Water

Figure 1:
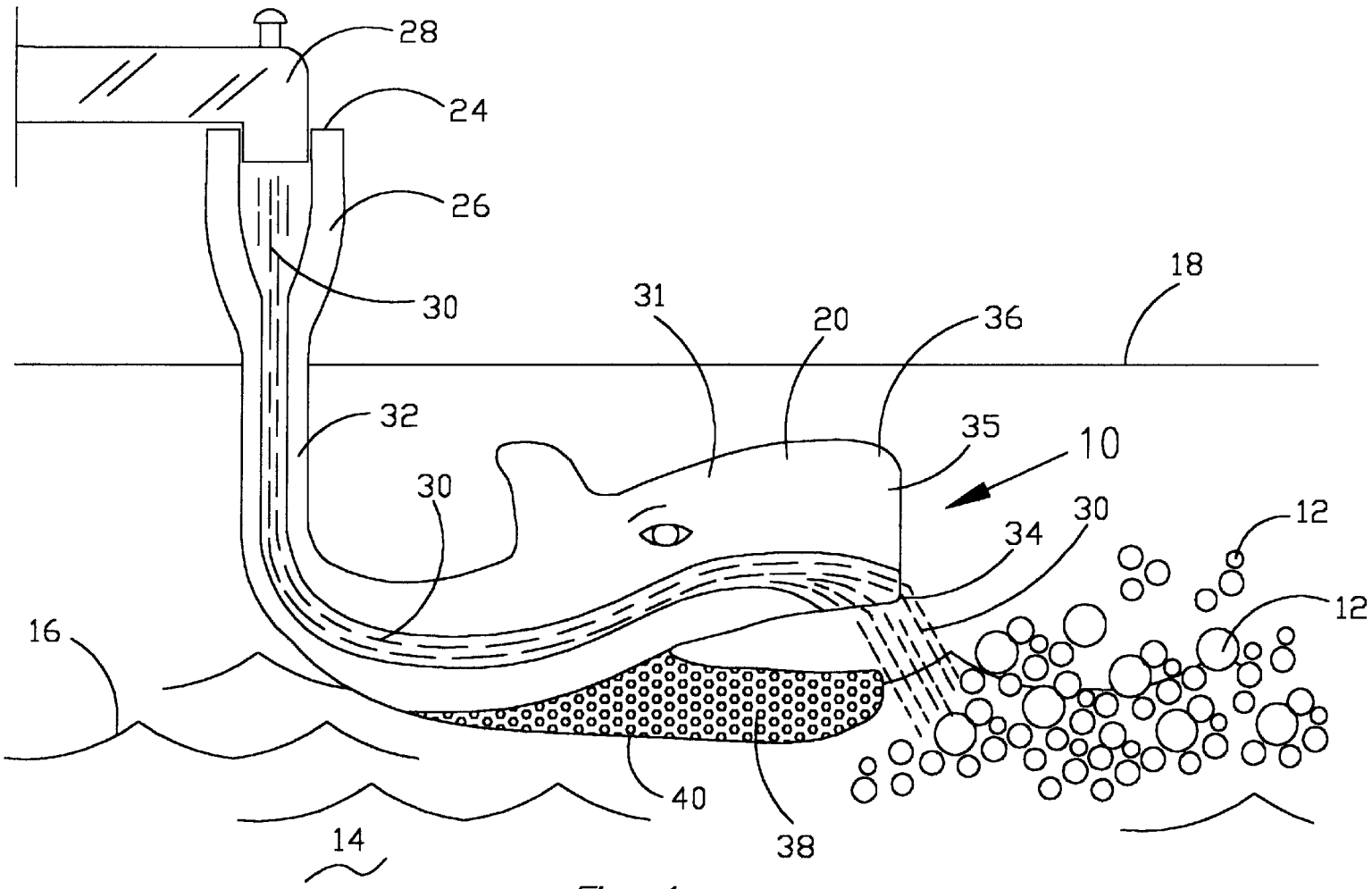
FIG. 1 is a side elevation of a preferred embodiment of the present invention, shown attached to a water faucet or tub spout and in use in a bathtub.

Referring now to FIG. 1, there is illustrated a device 10 for making bubbles 12 in bath water 14 that is constructed in accordance with a preferred embodiment of the present invention. The device 10 floats on a surface 16 of the bath water 14 in a bathtub 18 as the bathtub 18 fills with bath water 14. The device 10 is preferably formed into the shape of an animal or other friendly form, as illustrated by the whale form 20 that is employed in FIGS. 1 and 2 and the elephant form 22 that is employed in FIG. 3.

Figure 2:
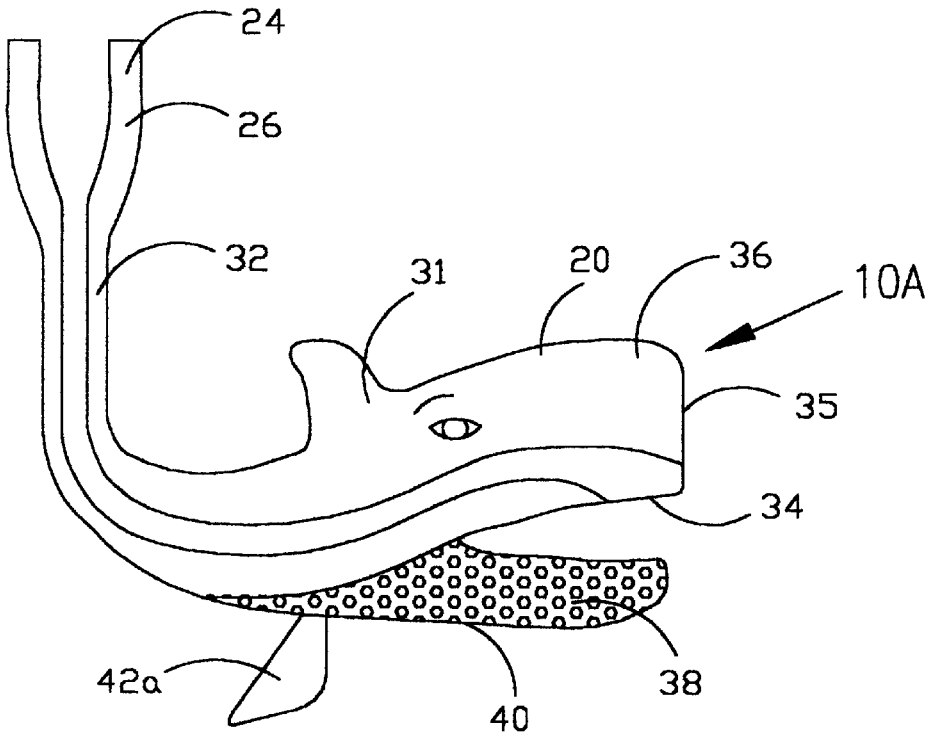
FIG. 2 is a side elevation of an alternate preferred embodiment of the present invention.
Figure 3:
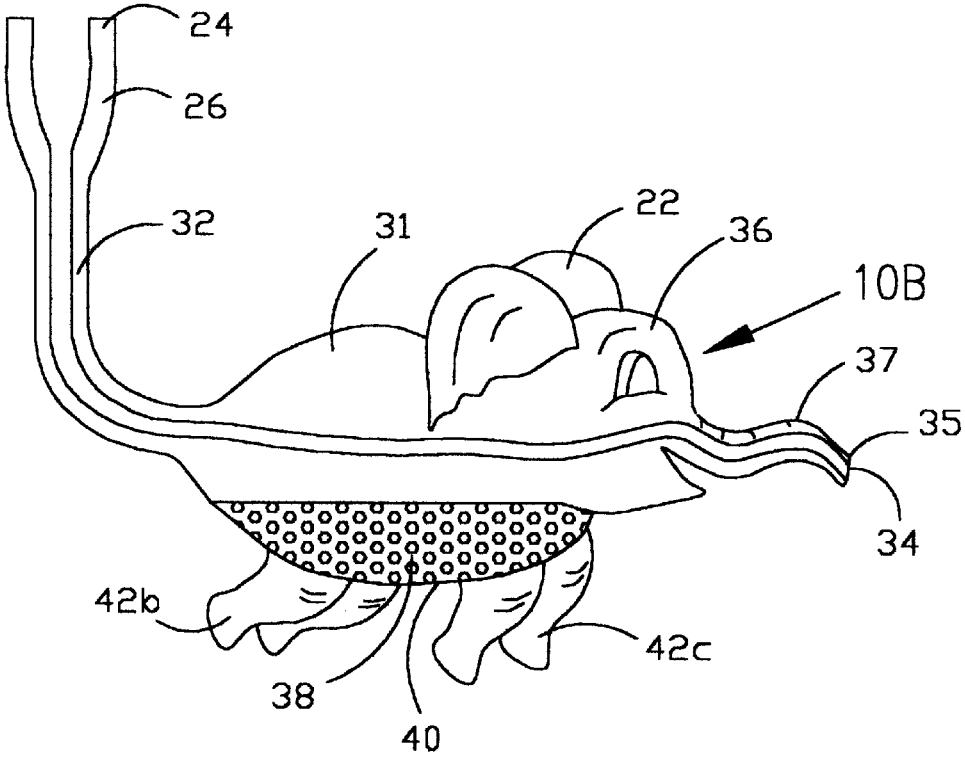
FIG. 3 is a side elevation of a second preferred embodiment of the present invention.

A first end 24 of the device 10 is provided with a flexible housing 26 that is designed to removably encase or engage a water faucet 28 or tub spout. Water 30 from the water faucet 28 or tub spout is forced to flow through the housing 26. The housing 26 is continuous with a flexible hose 32 and a conduit that runs through a body 31 of the device 10. The water 30 that enters the housing 26 must flow through the hose 32 and conduit and is forcefully directed downward from a spray head 34 provided on an opposite second end 36 of the device 10. The spray head 34, as illustrated in FIGS. 1–3, is preferably secured to an anterior end 35 of the body 31. The anterior end 35 of an animal shape or friendly form might be a mouth, trunk, snout or other similar structure provided on the anterior of the animal shape or friendly form. The water 30 sprays from the spray head 34 of the device 10 onto the surface 16 of the bath water 14, forming bubbles 12 in the bathtub 18.

The body 31 of the device 10 is provided with a float mechanism 38 in a lower portion 40 of the body 31. The float mechanism 38 may be constructed of Styrofoam, an enclosed air pocket, or other any other suitably buoyant mechanism. The float mechanism 38 causes the body 31 of the device 10 to float on the surface 16 of the bath water 14 as the water 30 from the faucet 28 or spout flows through the device 10. The flexible hose 32 that connects the body 31 to the housing 26 allows the body 31 of the device 10 to move from one side of the bathtub 18 to an opposite side of the bathtub 18, repeatedly back and forth in the bathtub 18.

As illustrated in for an alternate embodiment 10A in FIG. 2 and for a second embodiment 10B in FIG. 3, one or more rudders 42*a*, 42*b*, and 42*c* may optionally be provided extending downward from the lower portion of the body. Each rudder 42*a*, 42*b*, and 42*c* attaches to and rotates freely relative to the body 31 of the device 10. The purpose for providing rudders 42*a*, 42*b*, and 42*c* is so the rudders 42*a*, 42*b*, and 42*c* extend downward into the bath water 14 and facilitate in the side to side movement of the body 31 on the surface 16 of the bath water 14. The rotating movement of the rudders 42*a*, 42*b*, and 42*c* add to the lifelike appearance of the animal or friendly figure and enhance the invention's entertainment value as a bath toy.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for agitating bath water and bubble bath solution to form bubbles in a bath tub comprising:

a flexible housing that removably secures to a water faucet;

a flexible hose depending from the flexible housing so that water from the water faucet flows through the hose, a body that floats on the surface of the bath water, a conduit extending through the body, said flexible hose connected to one end of the conduit for feeding water from the faucet therethrough;

a spray head provided on said body so that water from the faucet sprays downward onto the surface of the bath water; and at least one rudder rotatably secured to a lower portion of said body as a means of assisting said body in moving from side to side.

2. A device for agitating bath water and bubble bath solution according to claim 1 wherein said body is in the shape of an animal.

3. A device for agitating bath water and bubble bath solution according to claim 1 wherein said spray head is secured to an anterior structure of said body.

4. A device for causing bubbles to be formed in bath water to which bubble bath solution has been added comprising:

a flexible hose;

means for removably securing a first end of the flexible hose to a water faucet;

a buoyant body for floating on the surface of the bath water, said body having a conduit extending therethrough, the second end of said flexible hose being coextensive with one end of the conduit, the other end of the conduit being attached to a spray head on the body so that water from the faucet is sprayed downward from the body onto the surface of the bath water; and at least one rudder rotatably secured to a lower portion of said body as a means of assisting said body in moving from side to side.

5. A device for causing bubbles to be formed according to claim 4 wherein said body is in the shape of an animal.

6. A device for causing bubbles to be formed according to claim 4 wherein said means for removably securing a first end of a flexible hose to a water faucet comprises:

a flexible housing that removably secures to a water faucet.

* * * * *